US005697111A

United States Patent [19]

Dillner et al.

[11] Patent Number: 5,697,111

[45] Date of Patent: Dec. 16, 1997

[54] FOLDABLE PLAYYARD HAVING LOCKABLE HUB

[75] Inventors: James Dillner, Leola; Nathaniel Saint, Morgantown, both of Pa.

[73] Assignee: Graco Children's Products Inc., Elverson, Pa.

[21] Appl. No.: 804,569

[22] Filed: Feb. 24, 1997

Related U.S. Application Data

[63] Continuation of Ser. No. 336,209, Nov. 4, 1994, abandoned.

[51] Int. Cl.[6] ..... A47D 7/00

[52] U.S. Cl. ..... 5/99.1; 5/93.1

[58] Field of Search ..... 5/93.1, 98.1, 99.1; 248/169, 188.6; 108/28

[56] References Cited

U.S. PATENT DOCUMENTS

| | | | |
|---|---|---|---|
| D. 304,523 | 11/1989 | Dillner et al. . | |
| 1,374,333 | 4/1921 | Stotler et al. . | |
| 2,197,791 | 4/1940 | Eddy . | |
| 2,498,203 | 2/1950 | Fischer . | |
| 2,574,079 | 11/1951 | White . | |
| 2,587,511 | 2/1952 | Nerman | 241/169 |
| 2,630,289 | 3/1953 | Selig | 248/169 |
| 2,962,034 | 11/1960 | Finlayson . | |
| 3,091,249 | 5/1963 | O'Neil . | |
| 3,810,482 | 5/1974 | Beavers . | |
| 4,008,499 | 2/1977 | Wren | 5/99.1 |
| 4,124,909 | 11/1978 | Saeedy | 5/99.1 |
| 4,688,280 | 8/1987 | Kohus et al. . | |
| 4,739,527 | 4/1988 | Kohus et al. . | |
| 4,811,437 | 3/1989 | Dillner et al. . | |
| 5,279,006 | 1/1994 | Teng | 5/99.1 |
| 5,358,220 | 10/1994 | Yu-Kuang | 5/99.1 |

FOREIGN PATENT DOCUMENTS

| | | | |
|---|---|---|---|
| 43051 | 7/1910 | Austria | 5/99.1 |
| 2 361 846 | 3/1978 | France . | |

*Primary Examiner*—Flemming Saether

*Attorney, Agent, or Firm*—Morgan, Lewis & Bockius LLP

[57] ABSTRACT

A foldable playyard that can stay in an erected state at all times regardless how the playyard is positioned comprises a hub which has a locking member. The playyard comprises a lower frame assembly, an upper frame assembly and corner legs. The lower frame assembly comprises a hub and a plurality of hub legs. One end portion of each of the hub legs is pivotally coupled to the hub. The upper frame assembly comprises a plurality of side rail units, each comprising a pair of rails and a medial rail connecting member pivotally connecting one end portions of the pair of rails. The medial rail connecting member enables the pair of rails to be collapsed from a substantially in-line configuration to a substantially V-shaped configuration. The corner legs interconnect the upper and lower frame assemblies. The hub according to the present invention is provided with a locking member which is positionable opposite the hub legs recesses which accommodates the end portions thereof to prevent the hub legs from pivoting relative to the hub. The hub further has a rotation prevention mechanism for preventing rotation of the locking member. The locking member is rotated by rotating a handle which first releases the rotation prevention mechanism.

39 Claims, 12 Drawing Sheets

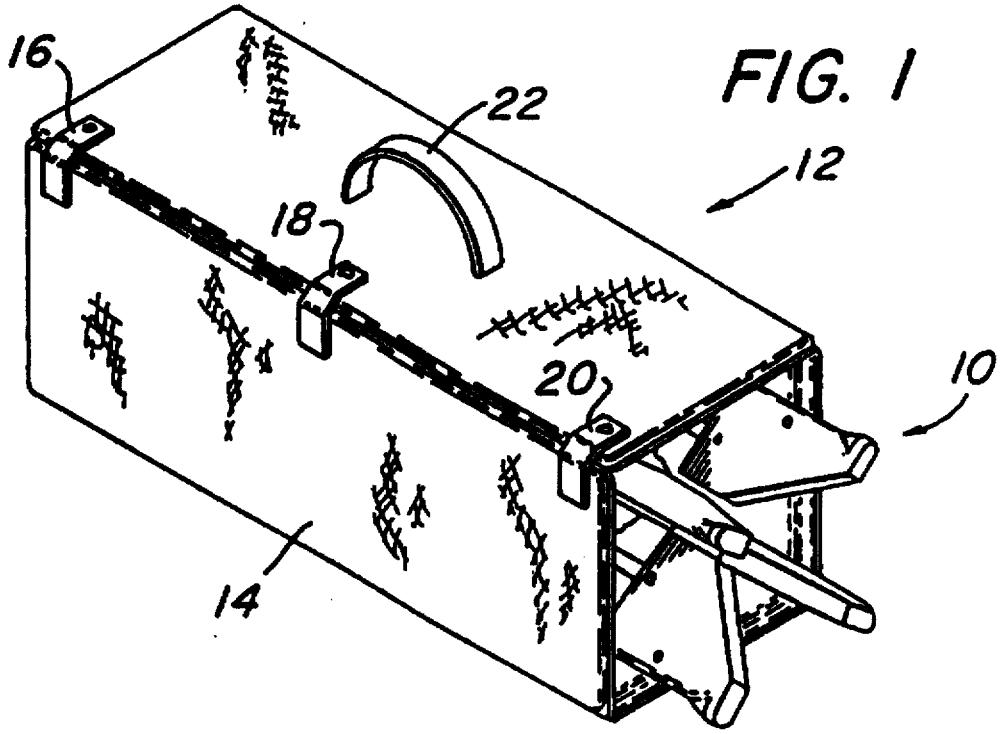
FIG. 1
FIG. 2
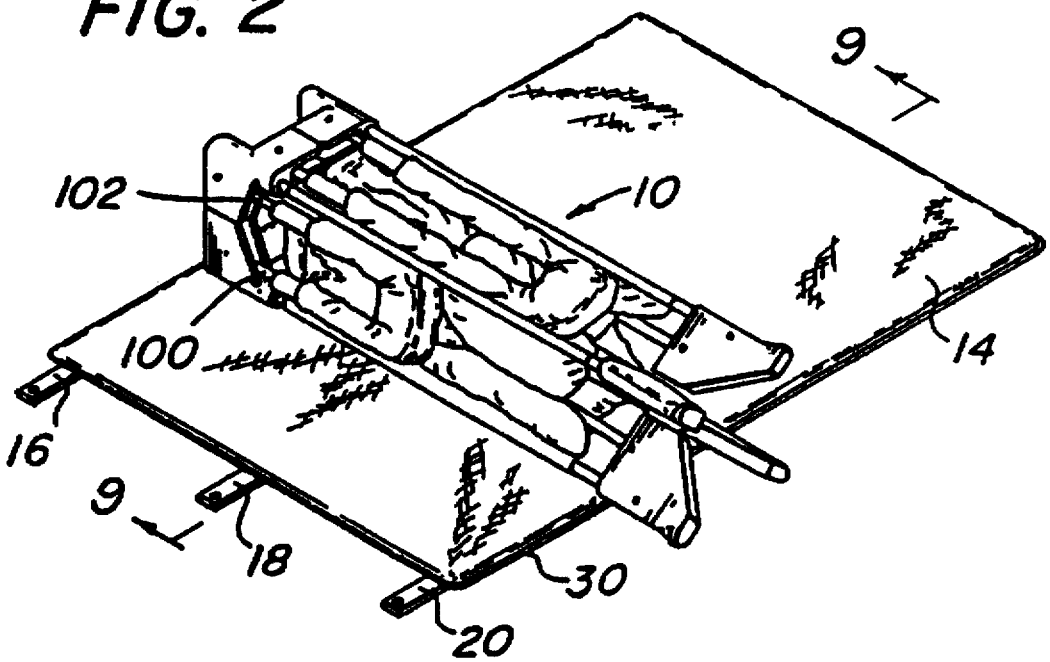

FOLDABLE PLAYYARD HAVING LOCKABLE HUB

This application is a continuation of application Ser. No. 08/336,209, filed Nov. 4, 1994, now abandoned.

BACKGROUND

An easily transportable playyard of a simplified structure having upper and lower frame assemblies, which is easily erectable and collapsible without re-assembly or disassembly of any parts, is described in U.S. Pat. No. 4,811,437 and shown in U.S. Pat. No. Des. 304,523 issued to Diller et al., the entire disclosures of which are incorporated herein by reference. The '437 patent describes a foldable playyard comprising upper and lower frame assemblies.

The lower frame assembly thereof comprises a hub, four lower corner leg connecting members and four hub legs. Each hub leg is pivotally coupled at one end portion to the hub and pivotably coupled to one of the corner leg connecting members at the opposite end portion thereof. The hub comprises a hub body having hub leg receiving sockets or recesses which permit the hub legs to pivot from a substantially horizontal co-planar spread-out configuration where the hub legs diverge outwardly from the hub to a compact non-coplanar configuration where the hub legs can be positioned substantially parallel.

The upper frame assembly thereof includes four upper corner connecting members and four foldable side rail units. Each rail unit has a pair of rails pivotally joined by a medial rail connecting member having a latching mechanism, which enables the rail pair to fold relative to each other from a substantially in-line configuration to a generally V-shaped configuration and vice-versa.

Four corner legs are connected to the upper corner connecting members and lower corner connecting members such that the corner legs are collapsible radially inwardly towards the hub in a substantially parallel compact configuration wherein the corner legs are drawn together by the hub legs and side rails.

When the playyard is in the erected use position, there is no need provide any means for preventing the hub legs from pivoting relative the hub since the weight of the hub and the hub legs and the playyard's removable and foldable floor member can maintain the hub legs in the horizontal coplanar spread configuration. However, there can be instances where the floor member is raised above the plane of the hub and the hub legs such as, for example, when using a raised bassinet. As an added precaution, it would be desirable to maintain the playyard in a locked erected state where the hub legs remain in horizontal coplanar spread-out configuration at all times, especially when the floor member is raised or even removed.

SUMMARY OF THE INVENTION

Accordingly, the present invention is drawn to a playyard that can be maintained in an erected state at all times regardless how the playyard is positioned. The present invention is also drawn to a hub that can be used with a playyard to maintain the same in an erected state at all times. The playyard in accordance with the present invention comprises a lower frame assembly and an upper frame assembly connected by corner legs. The lower frame assembly comprises a hub and a plurality of hub legs. One end portion of each of the hub legs is pivotally coupled to the hub and the other end portion of each of the hub legs is also operatively connected to a lower end portion of one of the corner legs.

The upper frame assembly comprises a plurality of side rail units, each comprising a pair of rails joined together by a medial rail connecting member pivotally connecting one end portions of the pair of rails. The medial rail connecting member enables the pair of rails to be collapsed from a substantially in-line configuration to a substantially V-shaped configuration.

The hub according to the present invention is provided with a movable locking member which prevents at least one of the hub legs from pivoting relative to the hub.

The playyard can further include a plurality of upper corner connecting members and a corresponding number of lower corner connecting members. Each of the upper corner connecting members is connected to an upper end portion of one of the corner legs. Similarly, each of the lower corner connecting members is connected to a lower end portion of one of the corner legs. The end portions of the rail units are pivotally coupled to the upper corner connecting members and the other end portions of the hub legs are pivotally coupled to the lower corner connecting members.

The lower frame assembly further can include a pair of stabilizer legs pivotally coupled to the hub so that they can be collapsible from a substantially co-planar spread configuration to a non-coplanar compact substantially parallel configuration. Preferably, the stabilizer legs are positioned diametrically opposite from each other, i.e., 180° degrees apart.

The hub according to the present invention includes a hub body to which the hub legs are pivotally coupled. The locking member is preferably rotatably coupled to the hub body. The locking member includes a plurality of outwardly extending blocking members which radially extend from its axis of rotation. The blocking members are rotatable in unison relative to the hub body to position each of the blocking members adjacent one of the end portions of the hub legs connected to the hub body in order to prevent the hub legs from pivoting relative to the hub. The hub further includes a handle unit operatively coupled to the locking member to actuate the locking member. The hub can also include a support member extending substantially perpendicularly from the blocking members to support the hub and the hub legs against a support fixture such as a floor or ground.

The hub body has a first side and a second side opposite the first side. The second side has a plurality of leg recesses or sockets dimensioned to accommodate the end portions of the hub legs and the support legs such that they can be collapsible from a substantially co-planar spread configuration where they diverge outwardly from the hub to a compact non-coplanar configuration where they are be positioned substantially parallel. The handle unit is positioned adjacent and opposite the first side and the blocking members are positioned adjacent and opposite the second side. Each of the blocking members is positionable opposite one of the leg recesses.

The hub body includes an opening, preferably a central opening, through which the handle unit is connected to the locking member. The locking member is pivotally coupled to the hub body about a first axis. The handle unit comprises a base member, preferably a relatively flat disc member, operatively attached to the locking member and a handle pivotally connected to the base member about a second axis which is preferably substantially perpendicular to the first axis. Rotation of the handle about the first axis causes the base member to rotate about the same first axis, causing the blocking members to rotate.

The hub preferably includes a rotation prevention mechanism operatively coupled to the hub body and the locking mechanism to prevent the locking member from rotating. The hub further includes a lock coupling mechanism coupled between the base member and the locking member. The lock coupling mechanism can disengage the rotation prevention mechanism and release the locking member. The locking member can only be rotated once the rotation prevention mechanism is released by first rotating the handle unit. Further rotation of the handle rotates the locking mechanism. Specifically, the lock coupling mechanism comprises a locking member driver rotatably connected to a cam member. The cam member is coupled so that it rotates relative to the driver for a predetermined degree before the cam member can rotate the driver. The driver is coupled to the locking member and the cam member is coupled to the base member of the handle unit. The rotation prevention mechanism engages the driver to prevent the driver from rotating, thus preventing the locking member from rotating.

The rotation preventing mechanism is rotatably coupled to the hub body and includes a driver engaging portion, a cam engaging portion and a biasing spring for biasing the driver engaging portion to engage the driver. The cam member engages the cam engaging portion to disengage the driver engaging portion from the driver upon rotation of the cam member to a predetermined degree, enabling the driver and the locking member to rotate together. Accordingly, to rotate the locking member to a unlocked position, the handle needs to be first rotated to a ,first predetermined degree to cause the cam member to first disengage and release the driver engaging portion from the driver. Up to this point, since the cam member is rotatable relative to the driver which is connected to the locking member, only the cam member is rotated while the locking member remains stationary in the locked position. Further rotation of the handle now causes the cam to rotate the driver. Since the driver is coupled to the locking member, rotation of the driver causes the locking member to rotate together. A spring device such as a torsion spring is operatively coupled to the locking member and the hub body to bias the blocking members in a locking position where the blocking members are positioned opposite the leg recesses. Specifically, one end of the torsion spring is connected to engage the hub body and the other end of the torsion spring is connected to engage the driver, which in connected to the locking member. The hub preferably includes another torsion spring for biasing the cam member away from the cam engaging portion. Specifically, one of the torsion spring is connected to the cam member and the other end of the torsion spring is connected to the driver.

BRIEF DESCRIPTION OF THE DRAWINGS

FIG. 1 is a perspective view of the foldable playyard according to the present invention in a collapsed position, housed within a carrying case formed by a discrete floor.

FIG. 2 is a perspective view of the collapsed playyard with the foldable floor unfolded.

DETAILED DESCRIPTION OF THE DRAWINGS

Although reference to directions have been made herein, they are made with respect to the drawings. Such reference is simply for the sake of convenience of description and is not intended to limit the present invention in structure or operation in any way, manner or form.

Figure 3:
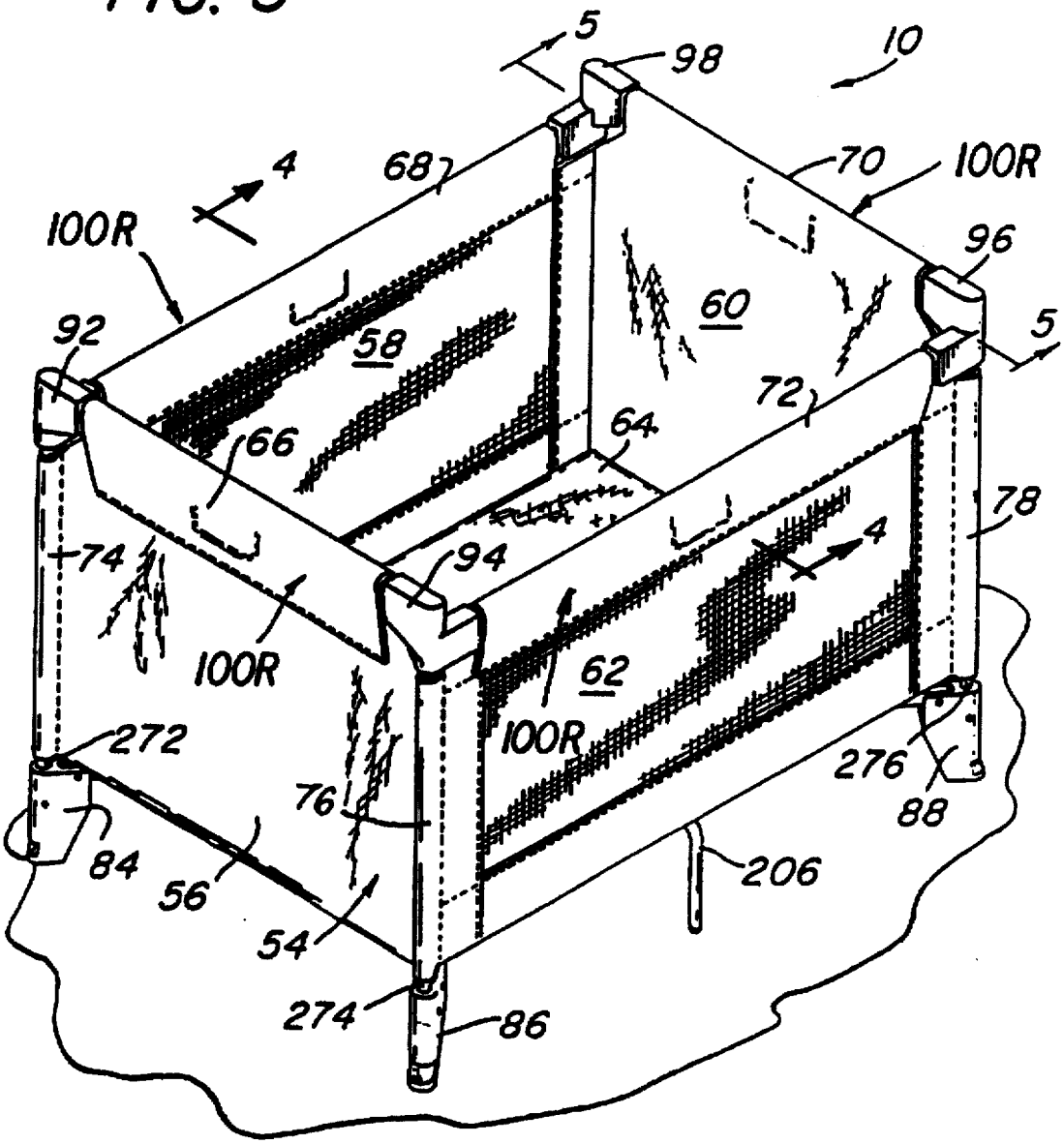
FIG. 3 is a perspective of the foldable playyard in the erected state wherein the playyard is ready for use.

FIG. 1 shows a perspective view of the playyard 10 according to the present invention in a collapsed and folded state, and housed in a box-shaped carrying case 12. FIG. 3 shows a perspective view of the foldable playyard 10 according to the present invention in its fully erected state. The playyard 10 has a frame generally defined by a lower frame assembly, not separately numbered; but shown in FIGS. 1, 2, 4, 8 and 10–18, an upper frame assembly, not separately numbered, but shown in FIGS. 2–8, and corner legs 272, 274, 276, and 278 connecting the upper and the lower frame assemblies.

Figure 5:
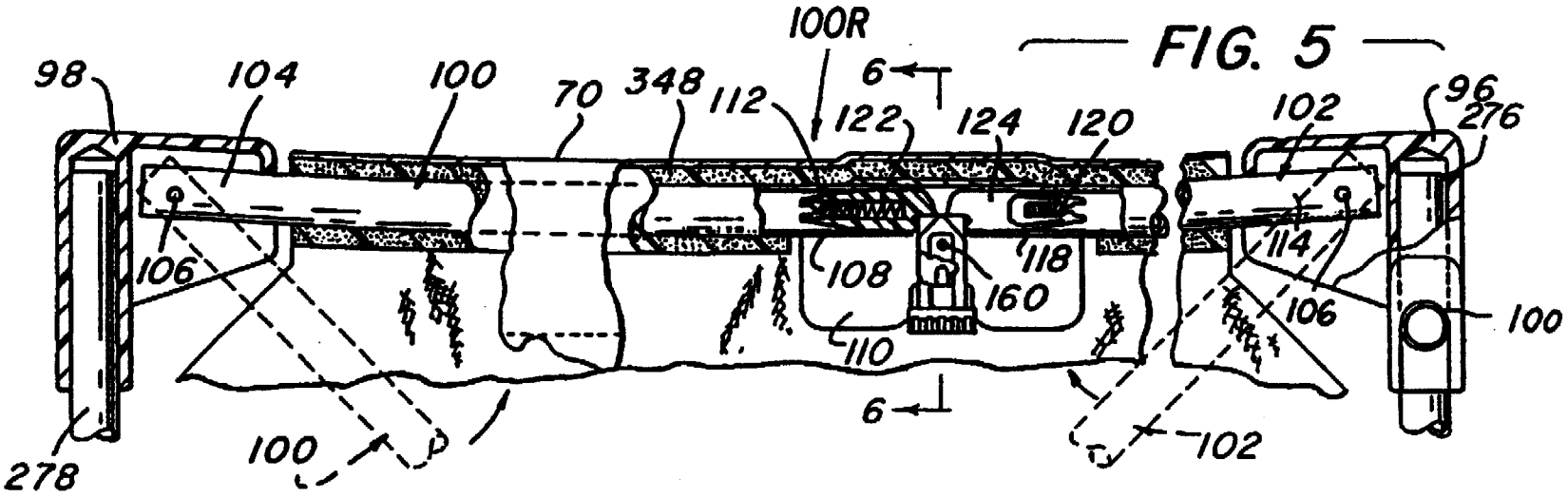
FIG. 5 is a section view taken along line 5—5 of FIG. 3.

As best shown in FIG. 3, the upper frame assembly comprises four substantially identical side rail units 100R hidden underneath four laterally extending tubular sleeves 66, 68, 70 and 72 connected to four substantially identical upper corner connecting members 92, 94, 96 and 98. As shown in FIG. 5, each rail unit 100R includes a pair of substantially rigid, tubular rails 100, 102, which may be made from any suitable material, such as a 22 gauge steel tube, and a medial rail connecting member 110. The lengths of the respective rails can be made to accommodate any size square or rectangular configuration of the playyard. The corner connecting members may be molded, for example, from a polymeric plastic materials such as ABS, polypropylene, nylon, etc. Each pair of adjacent corner connecting members (92,94; 94,96; 96,98; 98,92) supports one of the side rail units 100R at the upper portion of the playyard frame. Specifically, one end portion 104 of the rail 100 is received within one of the upper corner connecting members (98 shown), and is pivotably coupled thereto by a rivet pin 106 or the like extending through aligned openings in the respective upper corner connecting member and the rail end portion. The opposite end portion 108 of rail 100 extends within and is pivotably coupled to the medial rail connecting member 110 by a rivet 112 or the like extending through aligned openings in the medial rail connecting member and the rail end portion, as better shown in FIGS. 5 and 7.

The medial rail connecting member 110 is preferably made of a substantially rigid material and is provided with opposed cut-outs 116 and 116' to facilitate pivoting of rails 100, 102. The end portion 114 of the rail 102 extends within and is pivotably coupled to an associated upper corner connecting member (96 shown) by a rivet pin 106 or the like in the same manner as the end portion 104 of the rail unit 100R and its associated upper corner connecting member (98). The opposite end portion of the rail 102 extends within and is pivotably coupled to the medial rail connecting member 110 in the same manner as the end portion 108 of the rail 100.

Figure 7:
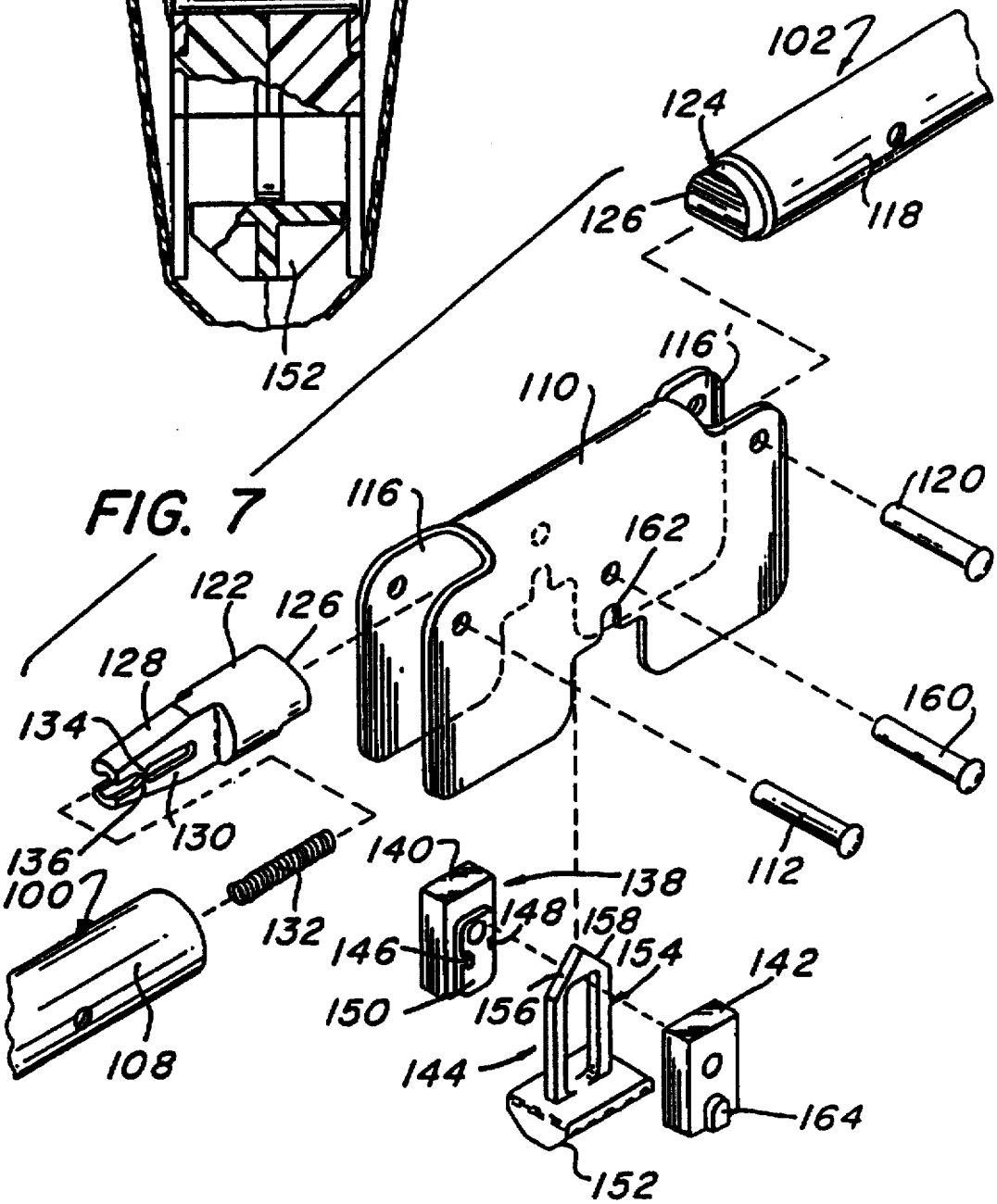
FIG. 7 is an exploded perspective view of the latch mechanism.

Each of the medial rail connecting members 110 houses a latch mechanism (not separately numbered) for latching the rails 100, 102 in a substantially in-line configuration when the playyard is erected. The latch mechanism includes a pair of opposed sprung pin members 122 and 124. Each sprung pin member (122, 124) is preferably made of a substantially rigid polymeric plastic material such as ABS, polypropylene, nylon, etc., and includes a nose portion 126 and flexible legs 128 and 130 extending therefrom. The legs 128 and 130 partially enclose a spring chamber (shown but not numbered) which is occupied by a compression spring 132, and have rib-type opposed projections 134 and 136, respectively. Each sprung pin member (122, 124) is assembled by inserting the spring 132 into the spring chamber and then telescoping the sprung pin member (122, 124) into the respective rail end portion (108, 118) as shown in FIGS. 5 and 7. Before the sprung pin member (122, 124) is telescoped within the rail end portion, the rail (100, 102) is pivotably coupled to the medial rail connecting member 110 by the rivet pin (112, 120) or the like. The sprung pin member (122, 124) is then inserted in the rail end portion (108, 118) so that the ribs 134 and 136 contact the rivet pin (112, 120) thereby spreading the legs 128 and 130 until the ribs 134 and 136 clear the rivet pin (112, 120). The legs 128 and 130 then snap back in place, capturing the rivet pin (112, 120). The spring 132 is captured between the rivet pin (112, 120) and an end wall (shown in FIG. 5 but not numbered) of the spring chamber.

Before the rails 100, 102 are pivotably coupled to the medial rail connecting member 110 and the pin members 122 and 124 are sprung in the rails, a portion of the latch mechanism comprising a holding member 138 having interlocking halves 140, 142 as shown in FIG. 7 is secured to the medial rail connecting members together with a latch releasing member 144. Each holding member half is provided with a lug 146 and a notch 148. Each lug-notch configuration is a mirror image of the other so that the holding member halves can be matingly interlocked prior to insertion in the medial rail connecting member. Each lug-notch configuration is formed on a land 150 which acts as a guide for the latch release member 144. The latch release member 144 includes a hand manipulable portion 152 and a slotted key portion 154 having converging cam surfaces 156, 158, as show in FIG. 7. In assembling the holding member and latch release member, a land 150 of one of the holding member halves 140 and 142 is located inside the slotted portion of key 154. The two holding member halves are then matingly interlocked by the lug and notch pairs. The assembled holding member 138 and latch release member 144 is then secured to medial rail connecting member 110 by a rivet pin 160 or the like which extends through the slotted portion of key 154 and aligned openings in holding member halves 140, 142 and the medial rail connecting member. To assist in locating the assembled holding member and the latch release member within the medial rail connecting member 110, each side of the medial rail connecting member is provided with a notch 162 and the outer face of each holding member half 140, 142 is provided with a matching lug 164.

After the holding member 138 and latch release member 144 are assembled and secured to the medial rail connecting member 110, the rails 100, 102 are pivotably coupled to the medial rail connecting member, and the pin members 122 and 124 are sprung in the rails as previously described. The entire assembly is then inserted in the laterally extending sleeve (70 shown in FIG. 5) of a side panel portion of the flexible enclosure. The outer end portions 104, 114 of the rails are then pivotably coupled to the associated upper corner connecting members 96 and 98, as shown in FIG. 5.

Although only one side rail unit has been described in connection with the playyard, it is to be understood that a substantially identical side rail unit is provided between each adjacent pair of upper corner connecting members, i.e., each side of the playyard. The above described process is repeated to assemble each of the side rail units.

Figure 8:
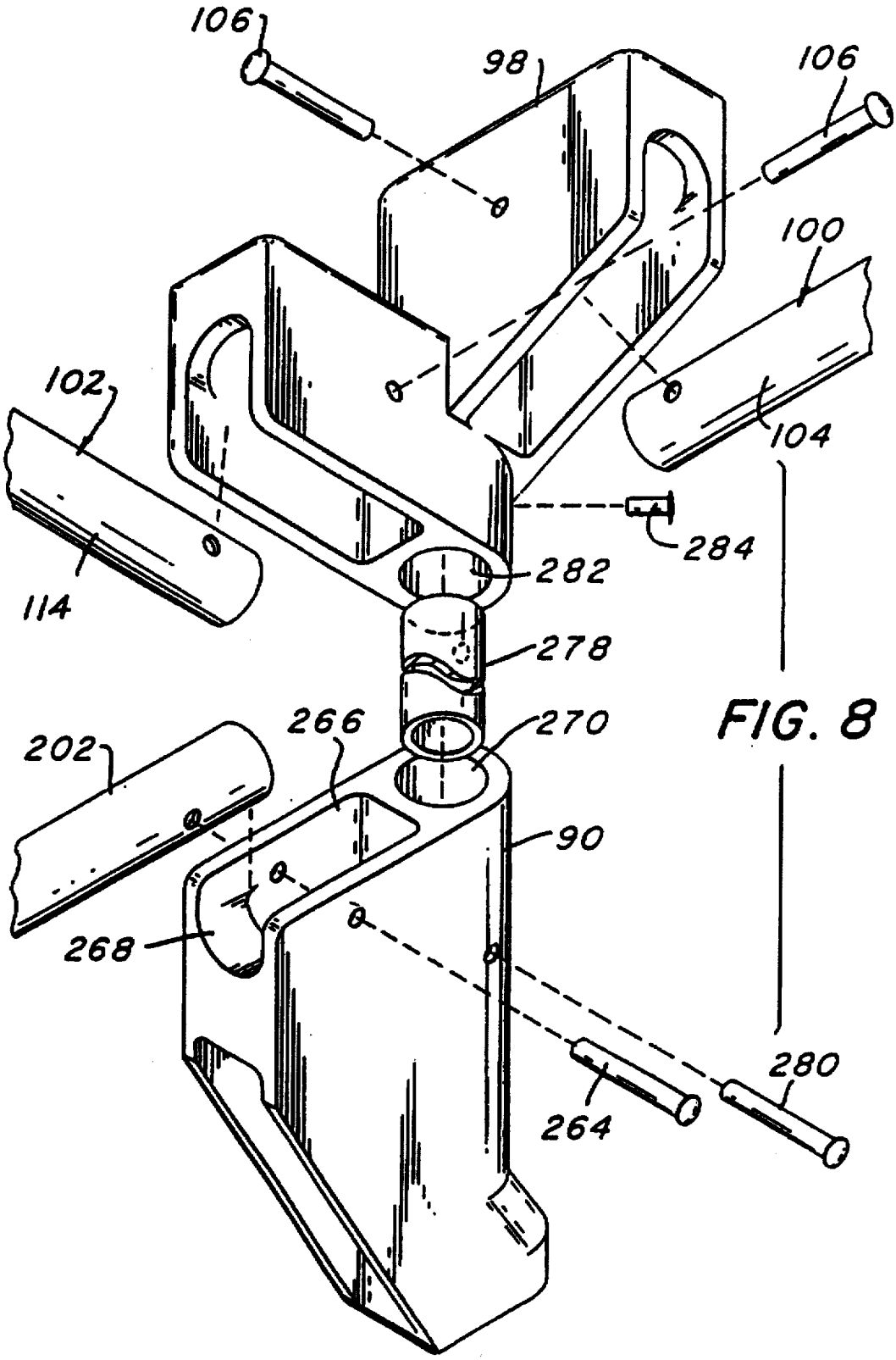
FIG. 8 is an exploded perspective view of the upper and lower corner connecting members.

The lower frame assembly of the playyard frame includes four substantially identical lower corner leg connecting members 84, 86, 88, 90, preferably in the form of support feet, and four substantially identical hub legs 202, 204, 208 and 210, and a hub 300. The lower corner connecting members also may be molded, for example, from any suitable polymeric plastic materials such as ABS, polypropylene, nylon, etc. The hub legs are preferably formed straight and may be made from any suitable substantially rigid material such as a 22 gauge steel tubing. The lower frame assembly can also include a pair of support legs 206, 212 for supporting the playyard on a fixture such as a floor. Each support leg includes a generally straight section which is pivotally connected to the hub and a curved free end or foot support portion 206'. The support leg can be made from the same tubing material and tubing dimension as the hub legs. As shown in FIG. 8, one end portion of each of the hub legs (202 shown) is pivotably coupled to one of the lower corner connecting member 84, 86, 88, 90 (90 shown) and the other end portion of each of the hub legs is pivotally coupled to the hub which is described in detail hereinbelow. One end portion of each hub leg is provided with diametrically opposed openings (shown but not numbered) in alignment with like openings (shown but not numbered) in the associated lower corner connecting member and is pivotably coupled thereto by a rivet pin 264 or the like which extends through the aligned hub leg and lower corner connecting member openings.

Each lower corner connecting member 84, 86, 88 and 90 is provided with a hollow interior clearance space 266 to accommodate pivoting movement of the hub leg end portion so as to enable movement of the hub leg from a substantially co-planar horizontal spread-out configuration wherein the hub legs diverge outwardly from the hub to a compact non-coplanar configuration where the hub legs can be positioned substantially parallel as shown in FIG. 2. Each lower corner connecting member is also provided with a leg support portion 268 which supports the end portion of the hub leg when the leg is in the substantially horizontal position, with the playyard erected.

Each of the corner legs 272, 274, 276 and 278 is connected to one of the lower corner connecting member 84, 86, 88, and 90 and one of the upper corner connecting member 92, 94, 96, 98 (98 shown in FIG. 8). In this regard, each lower corner connecting member is provided with a socket 270 for receiving a lower end portion of one of the four corner legs which can made of any suitable substantially rigid material such as a 22 gauge steel tubing. Similarly, each of the upper corner connecting member is provided with a socket 282 for receiving the upper end portion of one of the four corner legs. Each end portion of each corner leg is fixedly secured to the associated lower corner connecting member and the upper corner connecting member by a rivet 280, 284, or the like, respectively. Thus, each corner leg is fixedly secured to an upper corner connecting member which is part of the upper frame assembly of the playyard and to a lower corner connecting member which is part of the lower frame assembly of the playyard.

The corner legs 272, 274, 276 and 278 are spaced apart and upstanding in a substantially parallel configuration as shown in FIG. 3 when the playyard is erected. The hub legs are oriented substantially horizontally in a horizontal plane and the side rails are oriented substantially in-line so as to spread the corner legs in this configuration.

Figure 10:
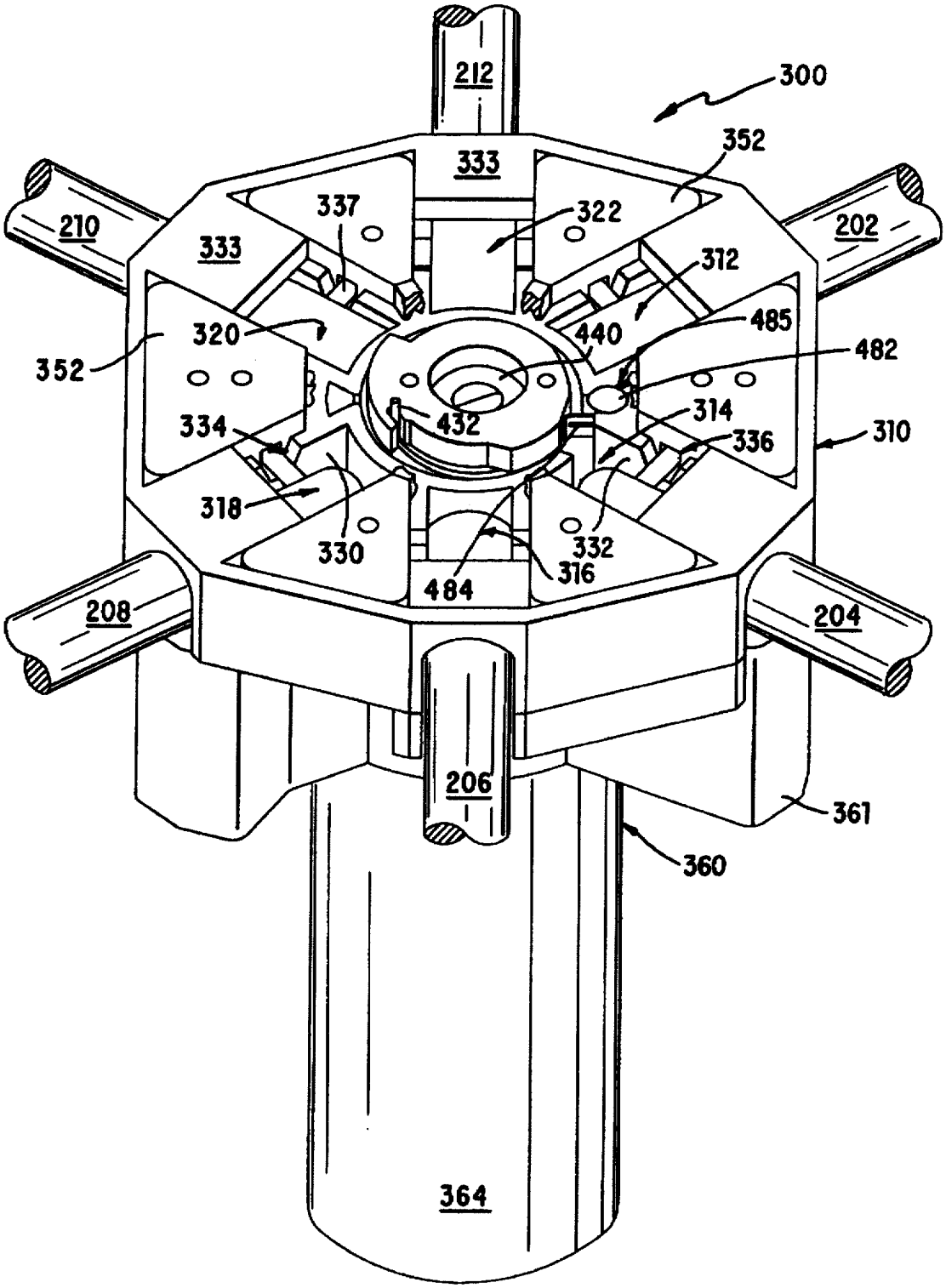
FIG. 10 is a perspective view of the hub according to the present invention, shown as assembled, but with the handle unit disconnected and some of the elements shown broken away.
Figure 11:
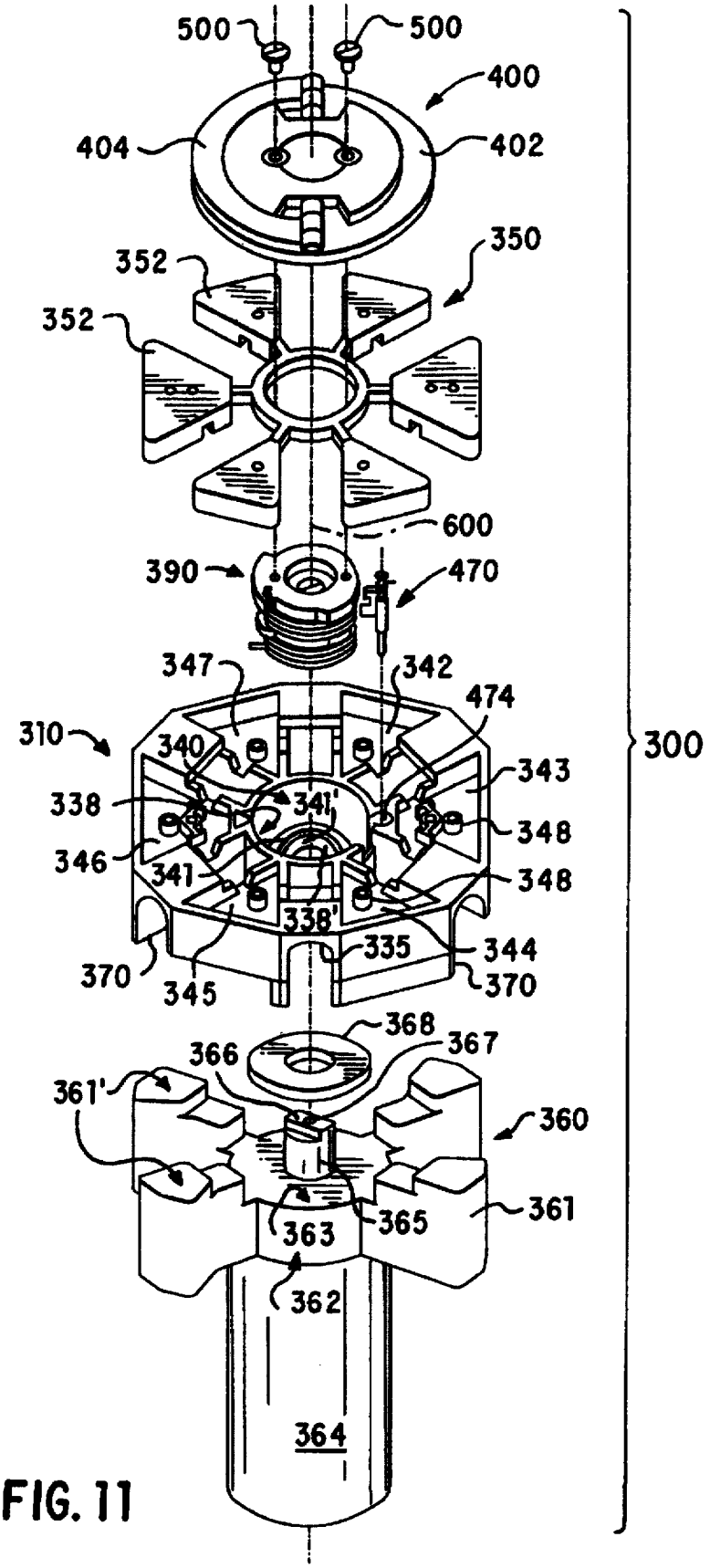
FIG. 11 is an exploded view of FIG. 10 with the handle unit, but with the hub and support legs disconnected therefrom.

As better shown in FIGS. 10 and 11, the hub 300 according to the present invention comprises a hub body 310, including a spider cover 350 for maintaining the pins 337 in their respective position relative to the hub body, a locking member 360, a handle unit 400, and a lock coupling member 390.

Figure 4:
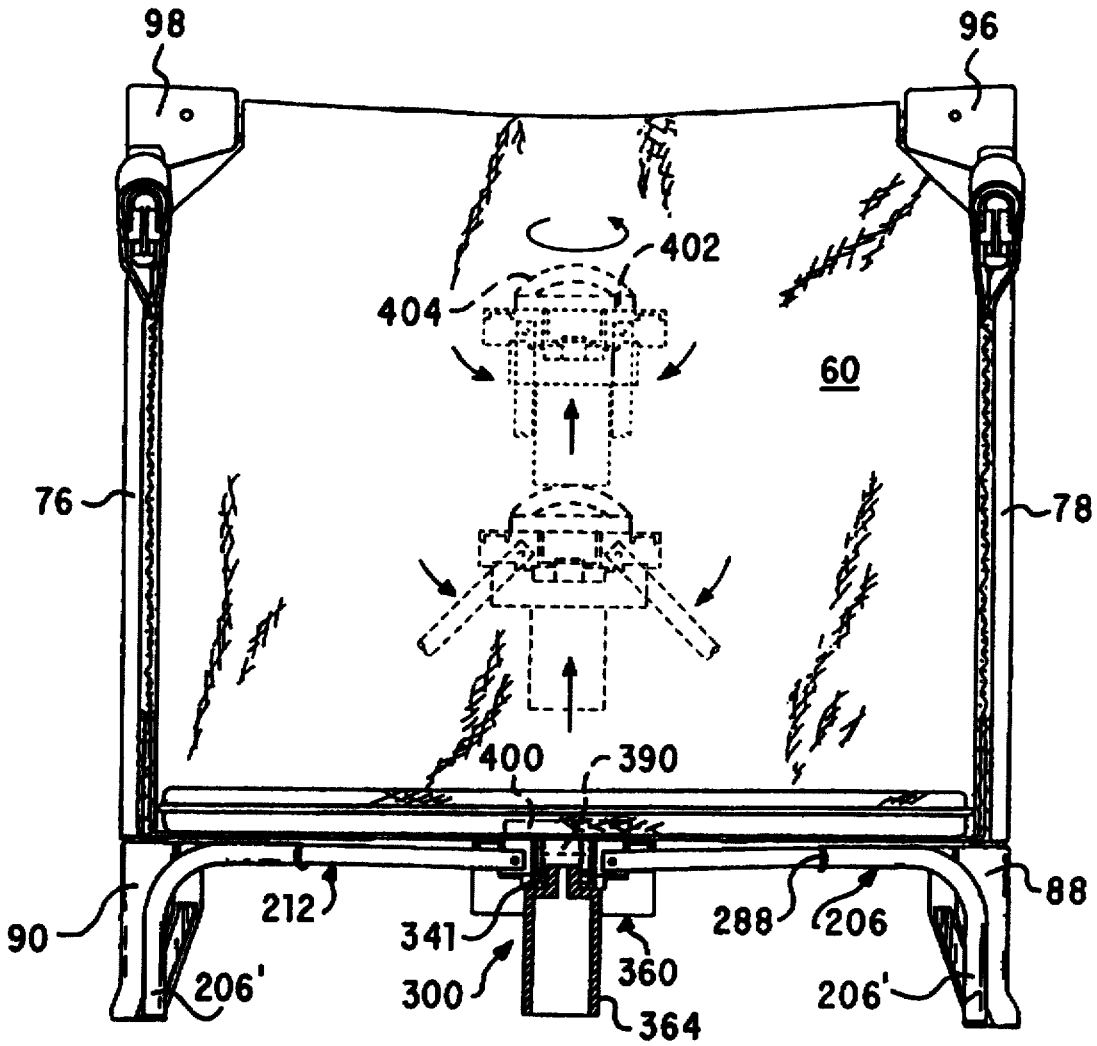
FIG. 4 is a section view taken along line 4—4 of FIG. 3.
Figure 12:
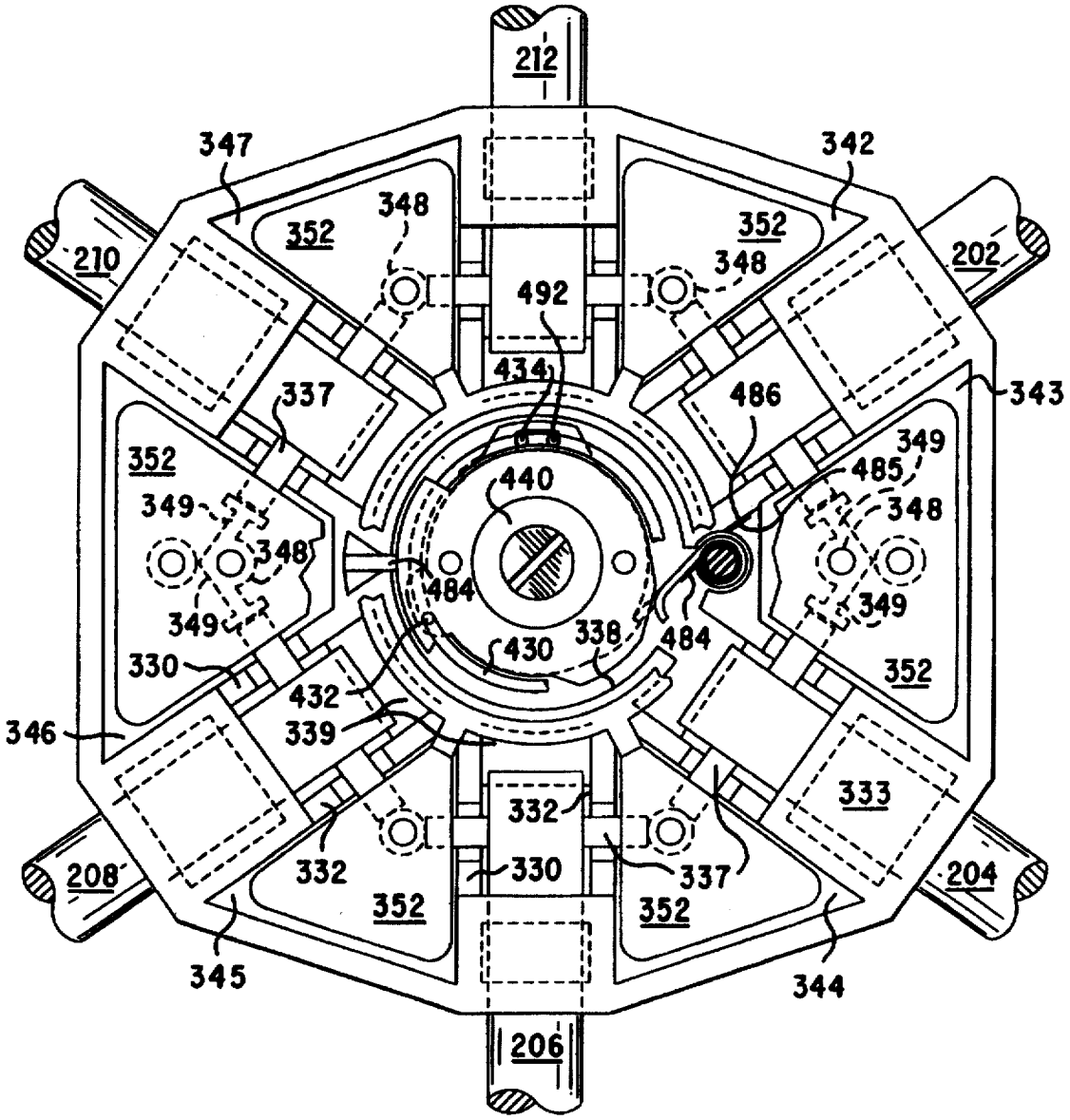
FIG. 12 is a top view of FIG. 10.

Specifically, the hub body 310 is preferably generally hexagonal in shape, although any other suitable configuration can be used. The hub body includes a first side (top) and a second side (bottom). The second side of the hub body 310 includes six leg receiving recesses or sockets 312, 314, 316, 318, 320, 322, as shown in FIGS. 10–12, to which an end portion of each of the four hub legs 202, 204, 208 and 210 and each of the support legs 206 and 212 is pivotally attached. The sockets are dimensioned to accommodate the end portions of the hub legs such that the hub legs can be collapsible from a substantially co-planar spread-out configuration as shown in FIG. 12 where the hub legs diverge outwardly from the hub to a compact non-coplanar configuration where the hub legs can be positioned substantially parallel as shown in FIGS. 2 and 4 (in phantom).

Each leg receiving socket is defined by a pair of opposed side walls 330 and 332 provided with collinearly aligned slots 334 and 336, respectively, for receiving a pivot pin 337. Each leg receiving socket also includes a side end wall portion 338, a partial top wall 333 having a substantially arcuate support surface 335 underneath thereof as better shown in FIG. 11 for supporting the hub legs 202, 204, 208 and 210 and the support legs 206 and 212. The side end wall portion 338 and a bottom wall 341 form a substantially cylindrical cup-like chamber 340 substantially centrally of the hub body. The bottom wall member 341 has a through opening 341'. Adjacent and contiguous to the end wall portion 338 and adjoining the side walls 340 and 342 is another bottom wall 339 for supporting the very end portion of the hub legs and the support legs as shown in FIG. 12.

An opening is thus provided on the top wall which enables one of the hub legs and the support legs to be inserted therethrough during assembly thereof in the leg receiving socket. The end portion of each hub leg is provided with aligned, diametrically opposed openings for receiving the pivot pin 337. During assembly, the end portion of the hub leg can be positioned to extend beyond the top wall 333. The pivot pin 337 can then be inserted through the opposed openings. Thereafter, the hub or support leg can be lowered to the associated leg receiving socket to seat the pivot pin within the aligned slots 334 and 336. The socket walls 330 and 332 are sufficiently spaced apart to provide a clearance for the hub leg to substantially freely pivot from a substantially co-planar horizontal spread configuration wherein the hub legs diverge outwardly from the hub to a compact non-coplanar configuration where the hub legs can be positioned substantially parallel as shown in FIGS. 2 and 4 (in phantom).

Alternatively, the opposed side walls 330 and 332 can be made to slightly converge to frictionally engage the end portion of the hub leg and maintain the hub legs in the horizontal position if desired. The undersurface portions 335 of the top walls 333 contact the hub and support legs so that they are supported thereon when they are swung to the substantially horizontal position.

As shown in FIG. 11, adjacent hub leg receiving sockets are spaced apart by six triangular-shaped wells 342, 343, 344, 345, 346 and 347. The opposed wells 343 and 346 are larger than the other wells and are of like dimensions. The other wells 342, 344, 345 and 347 are also of like dimensions.

After each of the hub legs is inserted in the leg receiving sockets, the spider cover 350 which includes six individual covers 352 corresponding to the geometry of the six wells is fastened to the hub body 310, using fasteners such as a snap fastener or screws, to maintain the pivot pins 337 secured in place. The six covers 352 are connected together as shown in FIG. 11. The hub body and the spider are preferably molded from a polymeric plastic material such as ABS, polypropylene, nylon, etc. Each of the triangular-shaped wells is provided with a circular rib 348 projecting upwardly from the well's bottom wall. The rib can serve to receive a fastening screw for holding the spider cover to the hub body and to prevent lateral movement of the pivot pins in adjacent leg receiving sockets. The circular rib projecting from the larger wells 343 and 346 each additionally have a pair laterally extending wall members 349 extending toward the two adjacent slots as shown in FIGS. 11 and 12 to limit the pivot pins from moving in their axial direction. Although the preferred embodiment is shown with a spider cover to maintain the pivot pins seated within the slots, any other conventional means can also be used to carry out the same function such as pin retainers.

The locking member 360 is pivotally coupled relative to the hub body 310 about a first axis 600 using a lock coupling mechanism 390. Specifically, the locking member comprises four substantially identical radially extending blocking members 361 extending from a substantially cylindrical body 362 which has an end wall 363. The blocking members are positioned adjacent the second side of the hub and angularly spaced such that the four blocking members are positionable opposite the four hub leg sockets 312, 314, 318 and 320 to which the hub legs 202, 204, 208 and 210 are pivotally coupled to. In the embodiment shown, the support leg sockets 316 and 322 to which the support legs 206 and 212 are pivotally connected need not be provided with the block members, but can be if desired. When the blocking members are positioned opposite the hub leg sockets, the hub legs are prevented from pivoting relative to the hub body about the pivot pin and thus are in a locked position. The blocking members are sufficiently spaced from the hub leg sockets such that a small clearance is provided between the second side of the hub body and each blocking member, the hub legs being sandwiched therebetween, to enable the blocking member to freely rotate, but sufficiently prevent the hub legs from pivoting relative to the hub body. This clearance ensures that the blocking members can be returned from to the locked position without being obstructed by the hub legs or any protruding elements on the second side of the hub body. In this regard, as shown in FIG. 11, each of the blocking members is stepped such that only the end portion 361' thereof is positioned close to the respective hub leg socket member.

The locking member 360 further includes a depending support leg 364 extending from the circular body which serves to support the hub and the hub and support legs on the support fixture such as a floor when the playyard is erected and positioned upright. The support leg 364 is preferably integral with the locking member. The locking member further includes a central cylindrical bearing stud 365 projection upwardly from the upper end wall 363 of the cylindrical body 362. The bearing stud 365 is provided with a diametrically extending projection 366 and a screw mating opening 367. The bearing stud 365 is rotatably coupled to the hub body 310 through the opening 341' formed on the bottom wall 341 of the hub body. The bearing stud protrudes into the cup-like chamber 340. The bottom wall 341 of the hub body, shown in FIGS. 4 and 11, also extends below the lower surface of the side walls 330 and 332, and includes a partial vertically upwardly extending wall 338' having a slightly larger inner diameter than the bearing stud 365 to accommodate the bearing stud therein. The wall 338' is concentric with the side end wall 338 as better shown in FIGS. 4 and 11. The outer side of the bottom wall 341 is substantially planar which is positioned adjacent the planar end wall 363 of the cylindrical body 362. Although not necessary, a flat washer 368 is preferably provided between the end wall 363 and the outer side of the bottom wall so as to provide a smooth metal to plastic bearing interface. The locking member can also be formed from a molded polymeric plastic material such as ABS, polypropylene, nylon, etc.

Figure 18A:
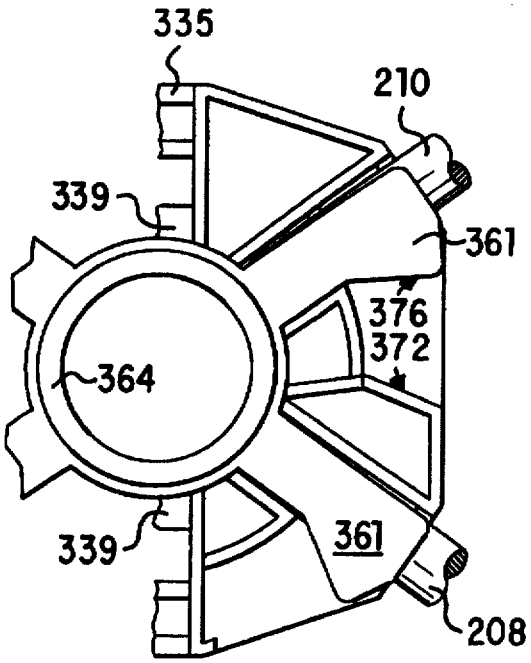
FIG. 18A is a schematic bottom view of the hub in the locked position where the blocking members block the hub legs.
Figure 18B:
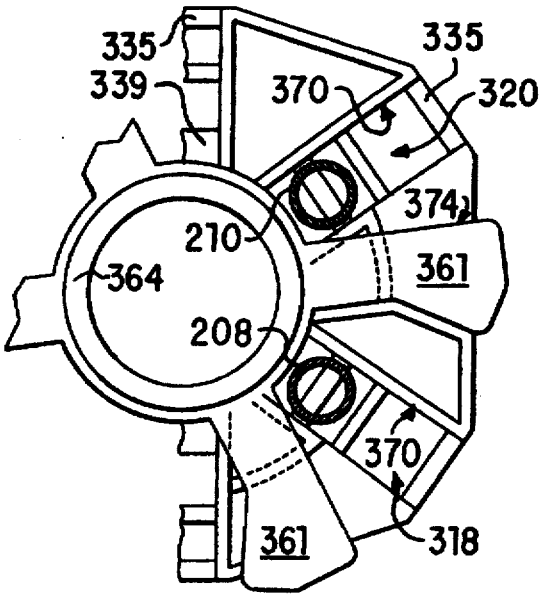
FIG. 18B is a schematic bottom view of the hub in the released position where the blocking members are rotated to permit the hub legs to pivot.

To limit the degree of rotation and to properly position the blocking members relative to the leg receiving sockets, the hub body 310 is provided with at least one pair of blocking member stops 370 and 372 as shown in FIGS. 18A and 18B. Specifically, the blocking member stops 370 extends vertically downwardly from each of the socket walls 330 of the hub leg sockets 312, 314, 318 and 320 as shown in FIGS. 11 and 18. The flat side 374 of each of the blocking members corresponding to the sockets 314 and 320 can abut against the corresponding flat stop 370 to correctly position the blocking members opposite the leg sockets 312, 314, 318 and 320 in a locking position. As shown in FIGS. 18A and 18B, an angled stop 372 (shown adjacent socket 318) complementary in shape with the angled side 376 of the blocking member is formed adjacent at least one of the flat stop 370 formed coextensive with the wall 330 of the diametrically opposite sockets 318 and 312. Although not shown, the angled stop is formed adjacent both the flat stops 370 associated with the diametrically opposite sockets 318 and 312 formed corresponding to the diametrically opposite sockets 314 and 320. The angled sides 376 of the blocking members 361 associated with the sockets 318 and 312 thus can abut against the corresponding angled stops 372 to maintain the blocking members in an unlocked position where the hub legs are free to pivot without any obstruction from the blocking members.

The locking member 360 is coupled to the handle unit 400 via the lock coupling mechanism 390. The handle unit comprises a flat plate-like circular base member 402 and a handle 404 pivotally coupled to the base member about a second axis which is substantially perpendicular to the first axis of rotation of the locking member. The handle preferably sits substantially flat against the base member as shown in FIG. 11. The lock coupling mechanism 390 comprises a cam member 420 and a locking member driver 450 as shown in FIGS. 11, 13, 15 and 16, which are all positioned substantially within the cup-like chamber 340 and between the locking member 360 and the base member 402. The base member 402 is positioned on the first side of the hub body, above the opening of the cup-like chamber 340. Rotation of the handle about the first axis causes the base member to rotate about the same first axis, first causing the cam member 420 to rotate.

The hub body includes a rotation prevention mechanism 470 pivotally coupled to the hub body and engages the locking member driver 450 to prevent the locking member from rotating. Rotation of the cam member by rotating the handle about the first axis disengages the rotation prevention mechanism from the locking member driver 450. The locking member can only be rotated once the rotation prevention mechanism is released by first rotating the handle unit. Further rotation of the handle rotates the locking member driver which is lockably coupled to the locking member to rotate the same.

Figure 14:
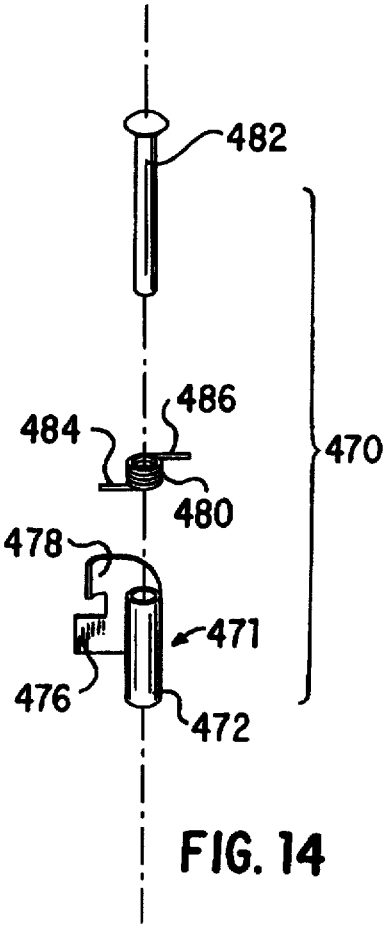
FIG. 14 is an enlarged exploded view of the rotation prevention mechanism shown in FIG. 11.
Figure 17A:
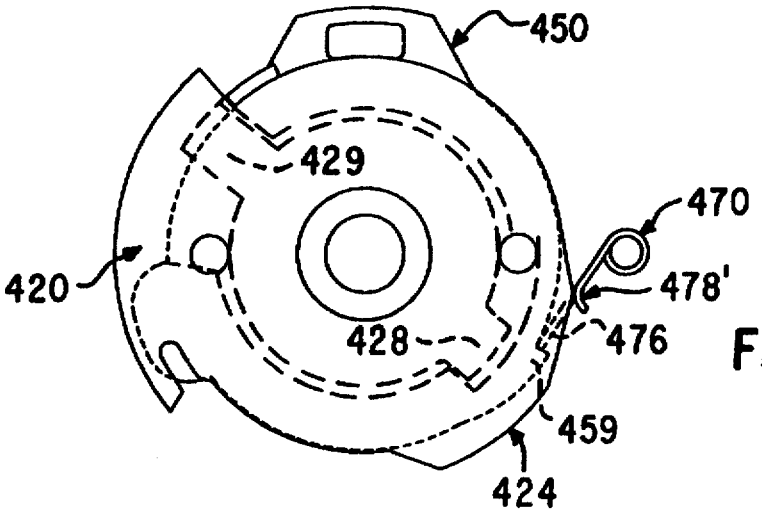
FIG. 17A is a schematic view of the lock coupling mechanism in a neutral (locked) position where the rotation prevention mechanism is engaged to the locking member driver.
Figure 17B:
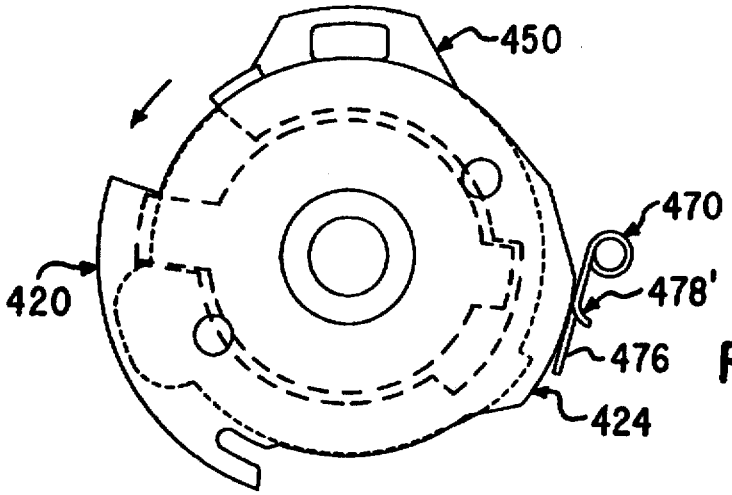
FIG. 17B is a schematic view of the lock coupling mechanism in an unlocked position where the rotation prevention mechanism is disengaged from the locking member driver.

Specifically, as shown in FIG. 14, the rotation prevention mechanism 470 includes a pawl member 471, a torsion spring 480 and a rivet 482 or the like. The rotation prevention mechanism 470 is inserted into a socket 474 formed adjacent the cup-like chamber 340 shown in FIGS. 10–12. The pawl member 471 includes a substantially tubular body 472 through which the rivet is inserted, a driver engaging portion 476 extending substantially laterally from the cylindrical body 472 which can abut against the locking member driver 450 as shown in FIGS. 12 and 17A. A cam engaging portion 478 also extends substantially parallel to the driver engaging portion and above thereof. As shown in FIG. 17B, the end portion 478' of the cam engaging portion is outwardly curved or bent substantially perpendicularly relative to the driver engaging portion. One end 484 of the spring 480 engages the pawl member 471 and the other end 486 of the spring 480 is connected to the hub body as shown in FIG. 12 to bias the driver engaging portion toward the center of the cup-like chamber to thereby cause the driver engaging portion 476 to engage the locking member driver. In this regard, the hub body is provided with a slot 485 to retain and hold the end 486 of the spring 480. The rivet 482 is inserted to the tubular body and the spring to retain the same relative to the hub body.

Figure 13:
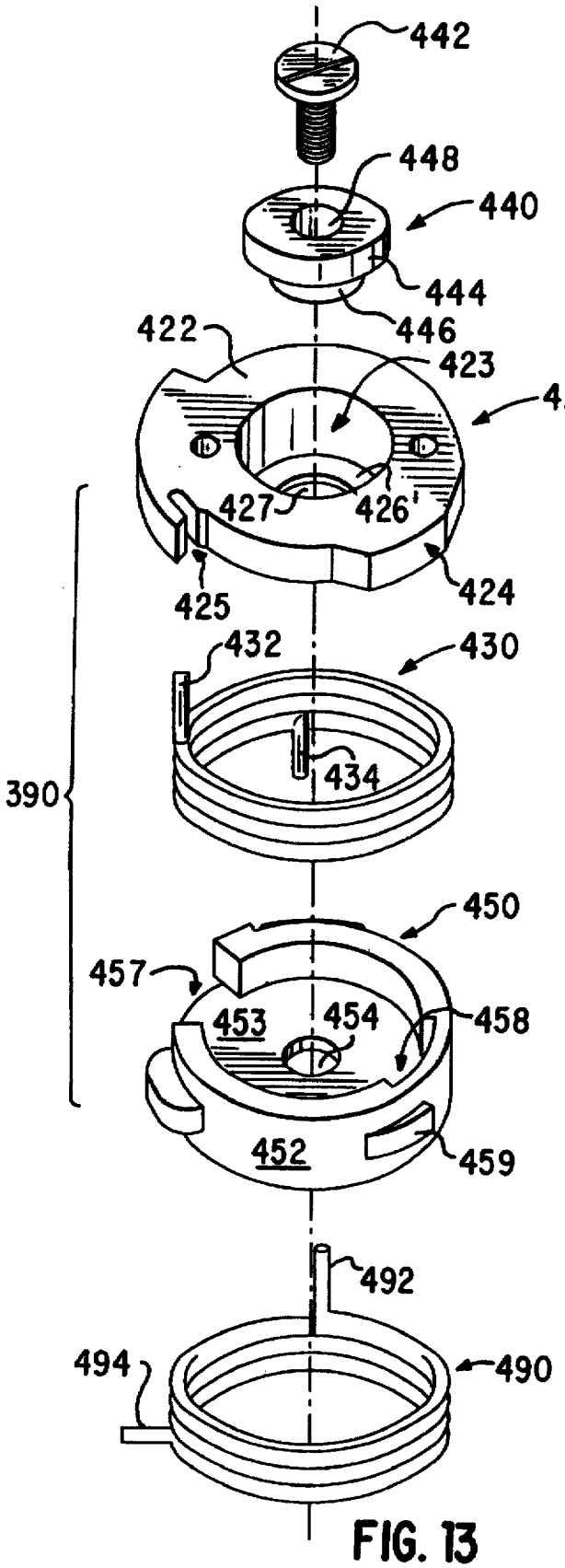
FIG. 13 is an enlarged exploded view of the lock coupling mechanism of the hub shown in FIG. 11.
Figure 15A:
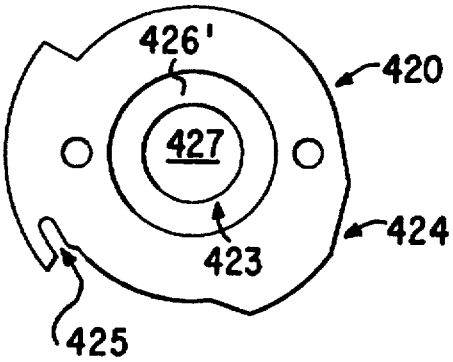
FIGS. 15A and 15B are top and bottom views of the cam member.
Figure 15B:
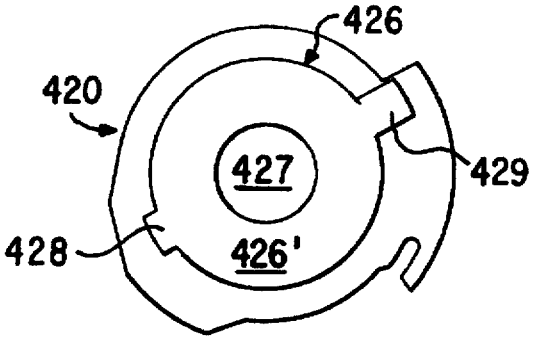

The cam member 420 comprises a substantially circular cam body 422 with a camming portion 424 which gradually extends radially outwardly from the cam body 422. The cam body also has a spring retaining slot 425 angularly spaced from the camming portion 424 for engaging and holding one end 432 of a torsion spring 430. A substantially cylindrical projection 426 extends collinearly from the underside of the cam body. The projection also has a diametrically opposed pair of radially extending stops 428 and 429 as shown in FIG. 15B for engaging the locking member driver described below. The cam body has a central recess 423 through which a hole 427 is formed. A shoulder washer 440 is inserted through the recess to abut against the medial wall 453 of the locking member driver 450. Specifically, as shown in FIG. 13, the shoulder washer 440 has a head portion 444 and a cylindrical extension portion 446 which collinearly extends from the head portion 444. A hole 448 extends through the shoulder washer for passage of the screw 442. The extension portion 446 has a smaller diameter than the head portion and dimensioned to pass through the hole 427 formed in the cam member. The end of the extension portion 446 extends through the hole 427 and engages the medial wall 453. In this regard, the length of the extension portion 446 is slightly longer than the thickness of the bottom wall 426' of the projection 426 to provide a small clearance between the head portion 444 and the bottom wall 426' of the cam member. This enables the shoulder washer to be tightly connected to the driver 450 and the cylindrical bearing stud 365 of the locking member 360 using a screw 442 or the like, while enabling the cam member to freely rotate relative to the driver.

The locking member driver 450 is collinearly coupled with the cam member 420 such that cam member can rotate relative to the driver as shown in FIGS. 17A and 17B for a predetermined degree. The locking member driver includes a substantially tubular driver body 452 having the radial mid-wall 453, forming an upper body portion 455 and a lower body portion 456. The mid-wall 453 has a central hole 454 for passage of the screw 442. The upper body portion 455 has a first slot 457 for receiving the stop 429 and a second slot 458 for receiving the stop 428. The cylindrical projection 426 of the cam member extends into the upper body portion 455 of the driver, with the stops 428 and 429 received in the slots 458 and 457. The slots 458 and 457 enable the cam member to rotate relative to the driver for a degree limited by the arc length of the slots prior to abutting the stop members. Any desired degree of relative rotation can thus be set by increasing or decreasing the arc length of the slots. Although two slots are provided, a single slot can also be utilized instead.

Figure 16A:
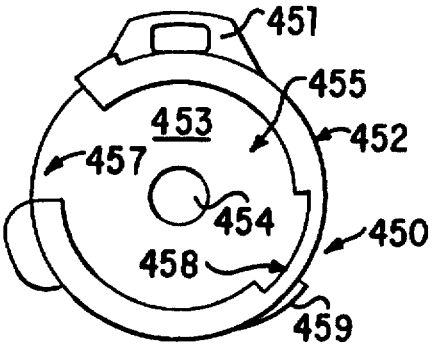
FIGS. 16A and 16B are top and bottom views of the locking member driver.
Figure 16B:
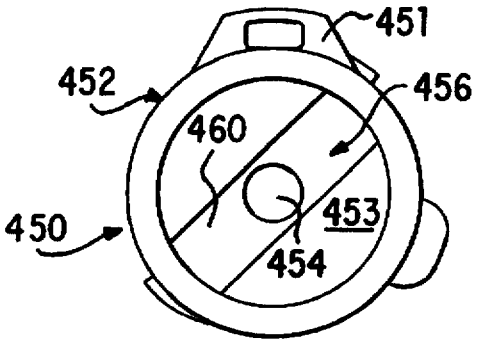

As shown in FIG. 16B, the lower body portion 456 is provided with a diametrical recess 460 dimensioned to mate with the diametrically extending projection 366 of the locking member such that there can be no relative rotational movement between the locking member and the driver. A spring retention member 451 extends radially outwardly from the driver body 452, providing an opening for insertion of the other end 434 of the torsion spring 430 and one end 492 of another biasing torsion spring 490. A rotation prevention engaging portion 459 extends radially outwardly from the driver body 452 for engaging with the driver engaging portion 476 of the rotation prevention mechanism 470.

The locking member driver is coupled to the locking member and the cam member is rotatably coupled to the driver. The torsion spring 430 is coupled coaxially with the driver and the cam member to bias the cam member in a clockwise direction relative to the driver such that the camming portion is adjacent the cam engaging portion 478 but with the driver engaging portion 476 engaged to the engaging portion 459. One end 492 of the torsion spring 490 is engaged to the driver which is coupled to the locking member and the other end 494 of the torsion spring is engaged to a recess formed in the hub body as shown in FIG. 12. The torsion spring 490 biases the driver and thus the locking member in a clockwise direction to cause the blocking members to abut against the stops 370 and properly position the blocking members opposite the hub leg sockets to lock the hub legs. The screw 442 securely holds the cam member, the driver and the hub body to the locking member.

Figure 17C:
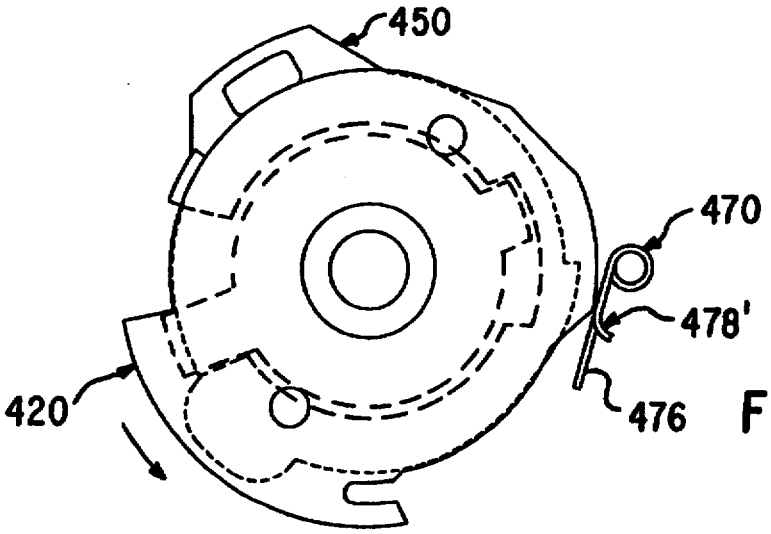
FIG. 17C is a schematic view of the lock coupling mechanism in a released position where the cam member and the driver are rotated together, rotating the locking member to enable the hub legs to rotate relative to the hub body.

To rotate the locking member, the driver must first be unlocked. This unlocking can only be accomplished by rotating the handle to rotate the cam member, the camming action causing the rotation preventing mechanism to be disengaged from the driver as shown in FIGS. 17A and 17B to unlock the driver and enable the driver and the locking member to rotate together. Up to this point shown in FIG. 17B, since the cam member is rotatable relative to the driver which is connected to the locking member, only the cam member is rotated while the locking member remains stationary, with the blocking members blocking the hub leg sockets. Further rotation of the handle now causes the cam to rotate the driver as shown in FIG. 17C. Since the driver is coupled to the locking member with no relative rotational movement therebetween, rotation of the driver causes the locking member to rotate. When the handle is released, the spring 490 biases the locking member in the clockwise direction as viewed from FIG. 12, causing the blocking members to assume their locking position opposite the hub leg sockets when the hub legs are swung to the horizontal spread out configuration.

The hub is preferably "overcentered", by making the length of the support leg 364 such that the hub body is supported on the floor slightly lower than the height at which the hub legs would be perfectly horizontal when the playyard is in its erect position. The hub is supported on the floor such that the hub legs are slightly angled downwardly toward the hub from the lower corner connecting members, i.e., slightly concave, enabling the hub legs to "pop" downwardly in its "overcenter" position. This enables the hub legs to remain tensioned between the hub body and the lower corner connecting members in its substantially horizontal spread-out configuration. To this end, the lengths of the support leg portions 206' are also made to accommodate the hub legs in a slightly concave, substantially horizontal position when the playyard is erected.

Figure 9:
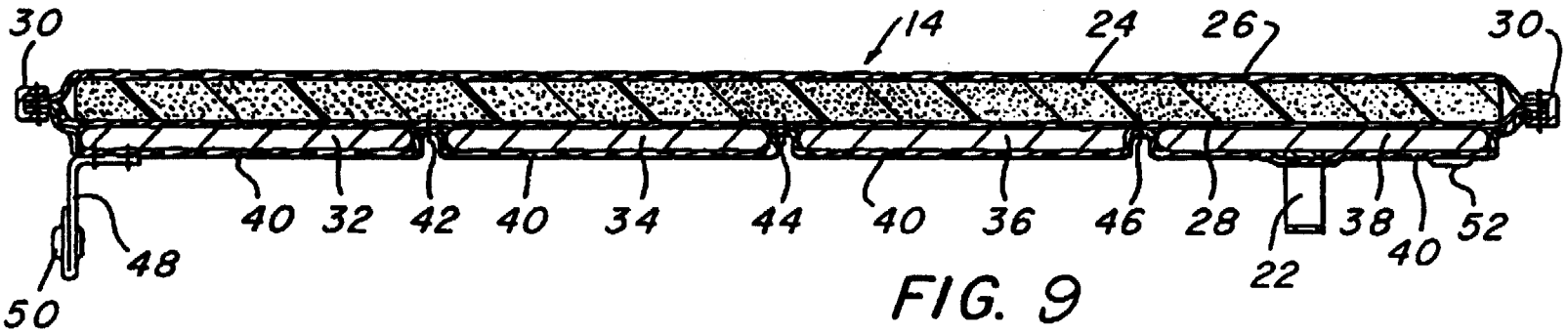
FIG. 9 is a cross sectional view of the foldable floor taken along line 9—9 of FIG. 2.

FIGS. 1 and 2 show perspective views of the playyard 10 according to the present invention in a collapsed and folded state. The box-shaped carrying case 12 is formed by a discrete foldable floor 14 having at least one fastener, preferably having three fasteners 16, 18, 20 and a carrying handle 22. As more clearly shown in FIG. 9, the foldable floor 14 comprises a foam cushion 24 enclosed within layers 26, 28 of fabric material such as nylon. Fabric layers 26, 28 are stitched together along their peripheries and to a fabric edging 30. The foldable floor 14 is partitioned into four sections, each containing one of four rigid panels 32, 34, 36, 38. Each panel may be made from any relatively rigid material such as a masonite material, wood, cardboard, plastics, etc. Each panel is disposed between the fabric 28 and a like layer of a fabric 40 which is stitched along its periphery to the layers 26, 28 and the edging 30. The fabric 40 is also stitched to the fabric 28 along parallel seams 42, 44, 46. The seams 42, 44, 46 partition the floor 14 into the four sections, each section containing one of the panels 32, 34, 46, 38. The sections are foldable about the seams 42, 44, 46 into the box-shaped configuration shown in FIG. 1. Each of the snap fasteners 16, 18, 20 comprises a flexible strap 48 stitched to the fabric 40 and provided with any conventional fasteners 50 such as a VELCRO, snap button, rings, etc.

Each fastener 16, 18, 20 releasably attaches to one of three mating fastener 52 on an opposite side of the floor 14. In use, the floor 14 is laid flat and positioned on the floor of the erected playyard as shown in FIG. 3, with the foam cushion side up. The fasteners 50, 52, the handle 22 and the stitching 42, 44, 46 thus are hidden underneath the foam cushion side.

Figure 6:
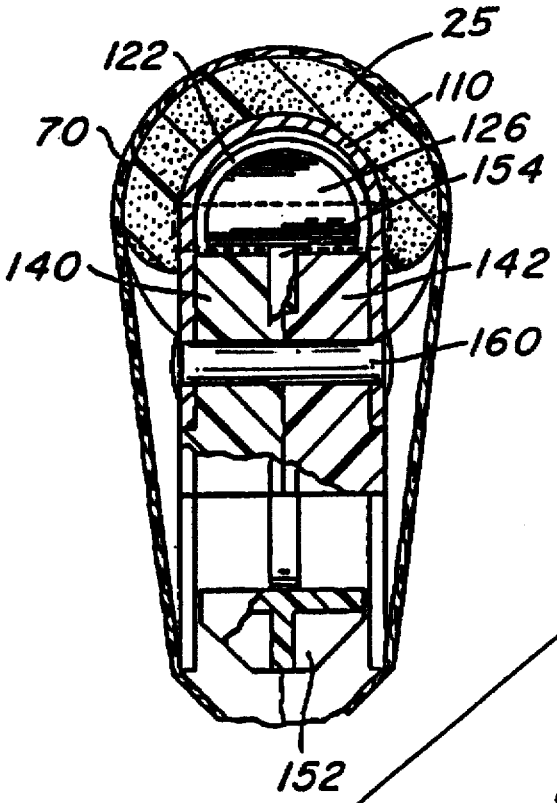
FIG. 6 is a section view taken along line 6—6 of FIG. 5.

The foldable playyard 10 further includes a flexible enclosure 54 connected to the frame. The flexible enclosure 54 comprises side panel portions 56, 58, 60, 62 and a floor portion 64. These portions of the enclosure are connected together, for example, by stitching. Each of the opposed side panel portions 58, 62 is preferably provided with a netting as shown in FIG. 3 so as to enhance ventilation and to allow the child to see and be seen. Each of the side panel portions 56, 58, 60, 62 includes a laterally extending tubular sleeve 66, 68, 70 or 72 for covering each of the rail units 100R and for connecting the side panel portions to the rail units. Each of the tubular sleeves preferably includes a cushion 25 or the like enclosed within the sleeve as shown in FIG. 6. The side panel portions are joined together by vertically extending tubular sleeves 74, 76, 78, 80 which covers the corner legs 272, 274, 276 and 278.

The floor portion 64 of the flexible enclosure rests on the hub legs 202, 204, 208 and 210 and the support legs 206 and 212, and the hub 300. Each support leg 206, 212 is slideably coupled to the enclosure floor portion by a loop or strap 288 as shown in FIG. 4. Further, a central portion of the floor portion is provided with a hub hole (not shown) substantially corresponding to the position and the size of the cup-like chamber 340 of the hub 300. The handle unit 400 is attached from above the floor portion so as to sandwich a portion of the floor portion between the hub body 310 and the base 402 of the handle unit. In this regard, a pair of conventional fasteners such as screws 500 can be used to fasten the base member 402 to the cam member as shown in FIG. 11.

In operation, to erect the playyard from a compact folded position where each pair of side rails 100, 102 is collapsed in a V-shaped configuration as shown in FIG. 2, each medial rail connecting member 110 is grasped and pulled upwardly so as to swing rails 100, 102 into a substantially in-line configuration as shown in FIG. 5. As rails 100, 102 swing upwardly, the nose portion 126 of each sprung pin member 122, 124 cammingly engages the sides of holding member 138, causing the pin members to retract against spring pressure until the nose portions clear the holding member. At that point, the pin members snap forwardly to engage the top edge portions of the holding member thereby latching the rails 100, 102 in the in-line configuration. The hub 300 is then pushed downwardly, which causes the hub legs to move to their horizontal position with the corner legs upstanding. The erected playyard assumes the shape shown in FIG. 3 with the corner legs spread apart by the hub legs and side rails. Once the playyard is erected, since the locking member is biased, the locking member automatically rotates to assume the locking position where each blocking member is positioned opposite the hub leg sockets 312, 314, 318 and 320.

To collapse the playyard, the handle is pivoted up from the base and rotated about the first axis which causes the cam member to release the driver engaging portion of the rotation prevention mechanism from the locking member driver. Further rotation of the handle in the same continuous rotation causes the cam member to positively engage the locking member driver and rotate the driver. Since the driver is coupled to the locking member, the locking member is also rotated, moving the blocking members away from the hub leg sockets. Once the blocking members are rotated away from the sockets, the hub can be pulled upwardly using the same handle so as to pivot the hub legs as shown in phantom in FIG. 4, thereby partially collapsing the lower frame assembly from the horizontal co-planar spread configuration. The hub legs prevents the locking member from returning to its biased locking position. With the hub legs partially collapsed, the rails 100, 102 of each side rail units can be released from the in-line configuration by grasping the connecting member and squeezing the latch release member 144 upwardly. The key cam surfaces 156, 158 cammingly engage the nose portions of pin members 122, 124, at the lower edge of each nose portion, thereby causing the pin members to retract against the spring pressure and clear the top of holding member 138. This releases the rails 100, 102 from the in-line configuration such that the medial rail connecting member 110 can be pushed downwardly so as to collapse the rails towards the V-shaped configuration. With the side rails collapsed, the hub can be pulled further upwardly so as to fully collapse the hub legs to a compact non-coplanar configuration where the hub legs are substantially parallel, with the lower portions of the corner legs, at the lower corner connecting member, drawn inwardly towards each other. The upper ends of the corner legs can be gathered towards each other so as to fully collapse the rails in the V-shaped configuration. Thus, the corner legs move from the upstanding spread configuration shown in FIGS. 3 and 4 to the compact configuration shown in FIG. 2. In both, configurations, the corner legs remain substantially parallel.

The side rails cannot be inadvertently collapsed since the side rails can be collapsed only if the hub is first pulled upwardly so as to partially collapse the corner legs by drawing the lower portions of the corner legs radially inwardly towards the hub, and the latch release member operated. If the hub is not pulled upwardly, the corner legs remain upstanding in the spread configuration and the latch release member resists operation, not allowing the collapse of the side rails. It was stated that when the playyard is in the erected use position, there is no need provide any means for preventing the hub legs from pivoting relative the hub since the weight of the hub and the hub legs and the playyard's removable and foldable floor member can maintain the hub legs in the horizontal coplanar spread-out configuration. However, due to the locking member of the present invention, the playyard is always positioned in a locked erected state, with the hub legs in a substantially horizontal coplanar spread-out configuration. This is particularly advantageous when the floor member is raised, removed or no load applied to the floor portion of the playyard, such as when used with a raised bassinet. The only way the hub legs can be collapsed is by first rotating the handle to release the rotation preventing mechanism and further rotating the locking member to move the blocking member away from the hub leg sockets and pulling up the hub.

Given the disclosure of the present invention, one versed in the art would readily appreciate the fact that there can be many other embodiments and modifications that are well within the scope and spirit of the disclosure set forth herein, but not specifically depicted and described. Accordingly, all expedient modifications readily attainable by one versed in the art from the disclosure set forth herein that are within the scope and spirit of the present invention are to be included as further embodiments of the present invention. The scope of the present invention accordingly is to be defined as set forth in the appended claims.

What is claimed is:

1. A foldable playyard comprising:

a lower frame assembly comprising a hub having a vertical axis and a plurality of hub legs, one end portion of each of said hub legs pivotally coupled to said hub;

an upper frame assembly comprising a plurality of side rail units, each comprising a pair of rails and a medial rail connecting member pivotally connected to an end portion of each of said pair of rails, said medial rail connecting member enabling said pair of rails to be collapsible from a substantially in-line configuration to a substantially V-shaped configuration;

a plurality of corner legs for interconnecting said upper and lower frame assemblies, wherein said hub includes a handle unit disposed on a first side of the hub and rotatable about the axis, and a movable locking member to prevent at least one of said hub legs from pivoting relative to the hub disposed on a second side of the hub opposite to the first side and wherein the locking member is rotated about the axis by the handle unit to a position adjacent at least one of the end portions of the hub legs.

2. A foldable playyard according to claim 1, further comprising a plurality of upper connecting members and a corresponding number of lower connecting members, each of said upper connecting members is connected to an upper end portion of one of said corner legs and each of said lower connecting members is connected to a lower end portion of one of said corner legs, wherein end portions of said rails are pivotally coupled to the upper connecting members and end portions of said hub legs are pivotally coupled to the lower connecting members.

3. A foldable playyard according to claim 2, wherein said lower frame assembly further comprises a pair of stabilizer legs pivotally coupled to said hub, said stabilizer legs being collapsible from a substantially co-planar spread configuration to a non-coplanar compact substantially parallel configuration.

4. A foldable playyard according to claim 1, wherein said hub includes a hub body to which said hub legs are pivotally coupled, said locking member being rotatably coupled to said hub body.

5. A foldable playyard according to claim 4, wherein said locking member includes a plurality of outwardly extending blocking members, said blocking members being rotatable relative to said hub body to position each of said blocking members adjacent and opposite one of the end portions of said hub legs connected to said hub body to prevent said hub legs from pivoting relative to said hub.

6. A foldable playyard according to claim 5, wherein said handle unit includes a base member and a semicircular handle coupled thereto.

7. A foldable playyard according to claim 5, wherein said hub body includes a first side and a second side opposite said first side, said second side having a plurality of recesses dimensioned to accommodate the end portions of said hub legs such that said hub legs can be collapsible from a substantially co-planar spread configuration wherein said hub legs diverge outwardly from said hub to a compact non-coplanar configuration where said hub legs can be positioned substantially parallel, wherein said handle unit is positioned adjacent said first side and said blocking members are positioned adjacent said second side, wherein each of said blocking members is positionable opposite one of said recesses.

8. A foldable playyard according to claim 7, wherein said hub further comprises a support member attached to said locking member for supporting said hub and said hub legs.

9. A foldable playyard according to claim 7, wherein the spring device operatively coupled between said locking member and said hub biases said blocking members in a locking position where said blocking members are positioned opposite said recesses.

10. A foldable playyard according to claim 9, wherein said hub body includes an opening through which said handle unit is operatively connected to said locking member.

11. A foldable playyard according to claim 10, wherein said locking member is pivotally coupled to said hub body about a first axis, said handle unit comprising a base member operatively connected to said locking member and a handle pivotally connected to said base member about a second axis, wherein rotation of said handle about said first axis causes said base member and said blocking members to rotate.

12. A foldable playyard according to claim 11, wherein said second axis is substantially perpendicular to said first axis.

13. A foldable playyard according to claim 1, wherein said hub further includes a rotation prevention mechanism operatively coupled to said hub and said locking member is rotatably coupled to said hub, and wherein said rotation prevention mechanism selectively prevents said locking member from rotating between the locking position and the release position.

14. A foldable playyard according to claim 13, further including a lock coupling mechanism disposed to said locking member, wherein said rotation prevention mechanism engages said lock coupling mechanism, wherein rotation of said lock coupling mechanism disengages said rotation prevention mechanism to permit rotation of said locking member.

15. A foldable playyard according to claim 14, wherein said lock coupling mechanism comprises a locking member driver and a cam member rotatably coupled to said driver such that said cam member is rotatable relative to said driver for a predetermined degree, said driver being coupled to said locking member, wherein said driver engages said rotation prevention mechanism to prevent said locking member from rotating.

16. A foldable playyard according to claim 13, wherein said rotation preventing mechanism is rotatably coupled to said hub and includes a driver engaging portion, a cam engaging portion and a biasing spring for biasing said driver engaging portion to engage said driver.

17. A foldable playyard according to claim 16, wherein said cam member engages said cam engaging portion to disengage said driver engaging portion from said driver upon rotation of said cam member to said predetermined degree to enable said driver to rotate.

18. A foldable playyard according to claim 17, wherein said hub further includes a biasing spring for biasing said cam member away from said cam engaging portion.

19. A hub for connecting one end portion of each of a plurality of hub legs of a lower frame assembly of a playyard, comprising:

a hub body, having a vertical axis for pivotally coupling to said one end portion of each of said hub legs;

a handle unit disposed on a first side of said hub body and rotatable about the axis; and a locking member movably coupled to and disposed on a second side of said hub body opposite the first side, said locking member is rotated about the axis by said handle unit to a position adjacent at least one of the end portions of said hub legs, wherein said at least one of the end portions is positioned between said hub body and said locking member to prevent the hub leg from pivoting relative to said hub body.

20. A hub according to claim 19, wherein said locking member is rotatably coupled to said hub body.

21. A hub according to claim 20, wherein said locking member includes a plurality of outwardly extending blocking members, said blocking members being rotatable in unison relative to said hub body to position each of said blocking member adjacent one of the end portions of said hub legs connecting to said hub body to prevent said hub legs from pivoting relative to said hub body.

22. A hub according to claim 21, further comprising a support member attached to said locking member and extending substantially perpendicularly to said blocking members.

23. A hub according to claim 21, wherein said handle unit includes a base member and a semicircular handle coupled thereto.

24. A hub according to claim 23, wherein said hub body includes a first side and a second side opposite said first side, said second side having a plurality of recesses dimensioned to accommodate the end portions of said hub legs such that said hub legs can be collapsible from a substantially co-planar spread configuration wherein said hub legs diverge outwardly from said hub to a compact non-coplanar configuration where said hub legs can be positioned substantially parallel, wherein said handle unit is positioned adjacent said first side and said blocking members are positioned adjacent said second side, wherein each of said blocking members is positionable opposite one of said recesses.

25. A hub according to claim 24, wherein the spring device coupling said locking member to said hub body biases said blocking members in said locking position where said blocking members are positioned opposite said recesses.

26. A hub according to claim 25, wherein said hub body includes an opening through which said handle unit is connected to said locking member.

27. A hub according to claim 26, wherein said handle unit comprises a base member operatively connected to said locking member and a handle pivotally connected to said base member.

28. A hub according to claim 27, wherein said locking member is pivotally coupled to said hub body about a first axis and said handle pivotally connected to said base member about a second axis, wherein rotation of said handle about said first axis causes said base member and said blocking members to rotate about said first axis.

29. A hub according to claim 28, wherein said second axis is substantially perpendicular to said first axis.

30. A hub according to claim 19, further including a rotation prevention mechanism operatively coupled to said hub body and said locking member to selectively prevent said locking member from moving between the locking position and the release position.

31. A hub according to claim 30, further including a lock coupling mechanism disposed to said locking member, wherein said rotation prevention mechanism engages said lock coupling mechanism, wherein rotation of said lock coupling mechanism disengages said rotation prevention mechanism to permit said locking member to move between the locking position and the release position.

32. A hub according to claim 31, wherein said lock coupling mechanism comprises a locking member driver and a cam member rotatably coupled to said driver such that said cam member is rotatable relative to said driver for a predetermined degree, said driver being coupled to said locking member and wherein said driver engages said rotation prevention mechanism to prevent said locking member from moving between the locking position and the release position.

33. A hub according to claim 32, wherein said rotation preventing mechanism is rotatably coupled to said hub body and includes a driver engaging portion, a cam engaging portion and a biasing spring for biasing said driver engaging portion to engage said driver.

34. A hub according to claim 33, wherein said cam member engages said cam engaging portion to disengage said driver engaging portion from said driver upon rotation of said cam member to said predetermined degree to enable said driver to rotate.

35. A hub according to claim 34, further including a biasing spring for biasing said cam member away from said cam engaging portion.

36. A hub for connecting one end portion of each of a plurality of hub legs of a lower frame assembly of a playyard, comprising:

a hub body, having a vertical axis, for pivotally coupling to said one end portion of each of said hub legs;

a handle member disposed on a first side of the hub body and rotatable about the axis;

a locking member coupled to said hub body and disposed on a second side of the hub body opposite the first side, said locking member is rotated about the axis between a locking position wherein said locking member is positioned adjacent at least one of the end portions of said hub legs, wherein said at least one of the end portions is positioned between said hub body and said locking member to prevent the hub leg from pivoting relative to said hub body, and a release position; and a motion prevention mechanism rotatably disposed on the hub body and operatively connected to the locking member, wherein the motion prevention mechanism is rotatable between a first position where the locking member is prevented from moving between the locking position and the release position, and a second position where the locking member is movable between the locking position and the release position.

37. The hub according to claim 36, further including a lock coupling mechanism disposed on said locking member, wherein said motion prevention mechanism engages said lock coupling mechanism to selectively prevent the locking member from moving between the locking position and the release position, wherein rotation of at least a portion of said lock coupling mechanism disengages said motion prevention mechanism to permit movement of said locking member.

38. The hub according to claim 37, wherein said lock coupling mechanism comprises a locking member driver and a cam member rotatably coupled to said driver such that said cam member is rotatable relative to said driver for a predetermined degree, said driver being coupled to said locking member and wherein said driver engages said motion prevention mechanism to prevent said locking member from moving between the locking position and the release position.

39. The hub according to claim 36 further comprising a spring device operatively coupling the locking member to the hub to bias the locking member toward the locking position.

* * * * *